US005234160A

United States Patent [19]

Lisiecki

[11] Patent Number: 5,234,160

[45] Date of Patent: Aug. 10, 1993

[54] ASEPTIC POUR SPOUT SEAL FOR FLAT TOP END CLOSURES

[75] Inventor: Robert E. Lisiecki, W. Bloomfield, Mich.

[73] Assignee: Elopak Systems A.G., Glattbrugg, Switzerland

[21] Appl. No.: 721,971

[22] Filed: Jun. 27, 1991

Related U.S. Application Data

[63] Continuation of Ser. No. 617,003, Nov. 21, 1990.

[51] Int. Cl.[5] ..... B65D 5/74

[52] U.S. Cl. ..... 229/214; 229/136; 229/217

[58] Field of Search ..... 229/136, 213, 214, 217; 206/631.1, 631.2, 631.3

[56] References Cited

U.S. PATENT DOCUMENTS

| | | | |
|---|---|---|---|
| 2,300,703 | 11/1942 | Ray | 229/217 |
| 3,147,904 | 9/1964 | Larson | 229/137 |
| 3,248,039 | 4/1966 | Locke | 229/137 |
| 4,078,715 | 3/1978 | Larsson et al. | 229/915 |
| 4,085,885 | 4/1978 | Lisiecki et al. | 229/915 |
| 4,422,570 | 12/1983 | Lisiecki | 229/248 |
| 4,546,915 | 10/1985 | Lisiecki | 229/137 |
| 4,582,246 | 4/1986 | Lisiecki | 229/137 |
| 4,588,122 | 5/1986 | Lisiecki | 229/137 |
| 4,730,770 | 3/1988 | Walton | 229/137 |
| 4,785,993 | 11/1988 | Lisiecki | 229/137 |
| 4,813,547 | 3/1989 | Wyberg | 229/137 |
| 4,872,562 | 10/1989 | Wyberg | 229/3.5 R |
| 5,018,660 | 5/1991 | Esper et al. | 229/136 |

*Primary Examiner*—Allan N. Shoap
*Assistant Examiner*—Christopher McDonald
*Attorney, Agent, or Firm*—Reising, Ethington, Barnard, Perry & Milton

[57] ABSTRACT

An aseptic pour spout seal for a flat top end closure having two oppositely disposed outer closure panels, and two oppositely disposed fold-in panels, one of which serves as the pour spout when opened. Each of the fold-in panels includes a substantially triangular panel portion, and a pair of fold-back panels integrally connected to and folded between the substantially triangular panel portion and the respective adjacent outer closure panels. Diagonal opening-assist score lines are formed on the outer closure panels adjacent the respective fold-back panels. An abhesive release coating is applied to the outside surfaces of the pour spout, and to the inside surfaces of either the pair of fold-back pour panels or the adjacent areas defined by the diagonal opening-assist score lines. A suitable sealant is overlain on the abhesive release coating on the pair of fold-back pour panels or the adjacent areas.

6 Claims, 3 Drawing Sheets

ASEPTIC POUR SPOUT SEAL FOR FLAT TOP END CLOSURES

This is a continuation of application Ser. No. 617,003, filed on Nov. 21, 1990.

TECHNICAL FIELD

This invention relates generally to thermoplastic coated flat top end closure type carrying liquids and blanks for constructing same and, more particularly, to an improved, easy openable aseptic pour spout therefor.

BACKGROUND ART

Containers for beverages such as milk and juices are conventionally constructed from thermoplastic coated paperboard. One common type of these containers includes a top end closure with a folded gable roof having a vertically projecting sealed fin at the roof ridge for sealing the container. Such containers are shown by U.S. Pat. No. 3,270,940. The bottom end closure for same is conventionally of the infolded type, such as that shown by U.S. Pat. No. 3,120,335.

Another type of container includes a slant top or a flat top end closure wherein what could otherwise be a vertically projecting sealed fin, or a slanted sealed fin, may be folded flat and releasably secured to the rest of the closure. U.S. Pat. Nos. 3,869,078 and 4,211,357 disclose such slant and/or flat top closures.

U.S. Pat. No. 4,422,570 is an example of an improved flat top end closure for a liquid carrying, paperboard container wherein the sealed fin previously used in conjunction with flat end closures is not required, but wherein a pitcher pour spout is included. An external lift tap is integrally formed on one outer closure panel for initial lifting of a portion of the pitcher pour spout, and an underlying lift tab is formed on one fold-back closure panel of another portion of the pitcher pout spout, in order to facilitate the opening process.

In liquid carrying paperboard container constructions generally, for sensitive food products, such as milk or juice, it is essential that the top closure be thoroughly sealable so as to be clean and sanitary and yet be functional from the standpoint of including means for readily opening the pouring spout thereof. As illustrated and described in the above-mentioned U.S. Pat. No. 3,270,940, anti-adhesive or "abhesive" patterns have been utilized, primarily on one or both sides of the rib panels located outward of the infolded triangular fold-back panels and inward of the outer edge sealing flaps. In the flat top structure disclosed in the above-mentioned U.S. pat. No. 4,422,570, wherein there is no conventional sealing fin, such as the usual rib panels and sealing flaps, other arrangements for releasably sealing the top closure are required.

U.S. Pat. No. 4,582,246 discloses a flat top closure of the non-sealing fin type disclosed in the above-mentioned U.S. Pat. No. 4,422,570, and including predetermined inner and outer surface abhesive patterns, and an optional embossment filled with a supplementary sealant material, and/or partial cut lines which serve to facilitate the container opening operation.

DISCLOSURE OF THE INVENTION

A general object of the invention is to provide an improved flat top end closure for a liquid carrying, paperboard container, wherein various features are included for aseptically sealing same while enhancing the separation of the pouring spout panels as the spout is folded back by the user.

Another object of the invention is to provide a flat top end closure, including anti-adhesive or "abhesive" coated panel segments and a molten sealant or suitable caulking material applied to selected abhesive coated panels segments to sterilize same.

A further object of the invention is to provide a flat top end closure including an abhesive coating on the outside surfaces of the pour spout panel segments, and a further abhesive coating covered by a sealant on selected inside panel segment surfaces.

Still another object of the invention is to provide an aseptic pour spout seal for a flat top end closure having two oppositely disposed outer closure panels, and two oppositely disposed fold-in panels, one of which serves as the pour spout when opened. Each of the fold-in panels includes a substantially triangular panel portion, and a pair of fold-back panels integrally connected to and folded between the substantially triangular panel portion and the respective adjacent outer closure panels. Diagonal opening-assist score lines are formed on the outer closure panels adjacent the respective fold-back panels. An abhesive release coating is applied to the outside surfaces of the pour spout, and to the inside surfaces of either the pair of fold-back pour panels or the adjacent areas defined by the diagonal opening-assist score lines. A suitable sealant is overlain on the abhesive release coating on the pair of fold-back pour panels or the adjacent areas.

These and other objects and advantages of the invention will be apparent when reference is made to the following drawings and accompanying description.

BEST MODE OF CARRYING OUT THE INVENTION

Figure 1:
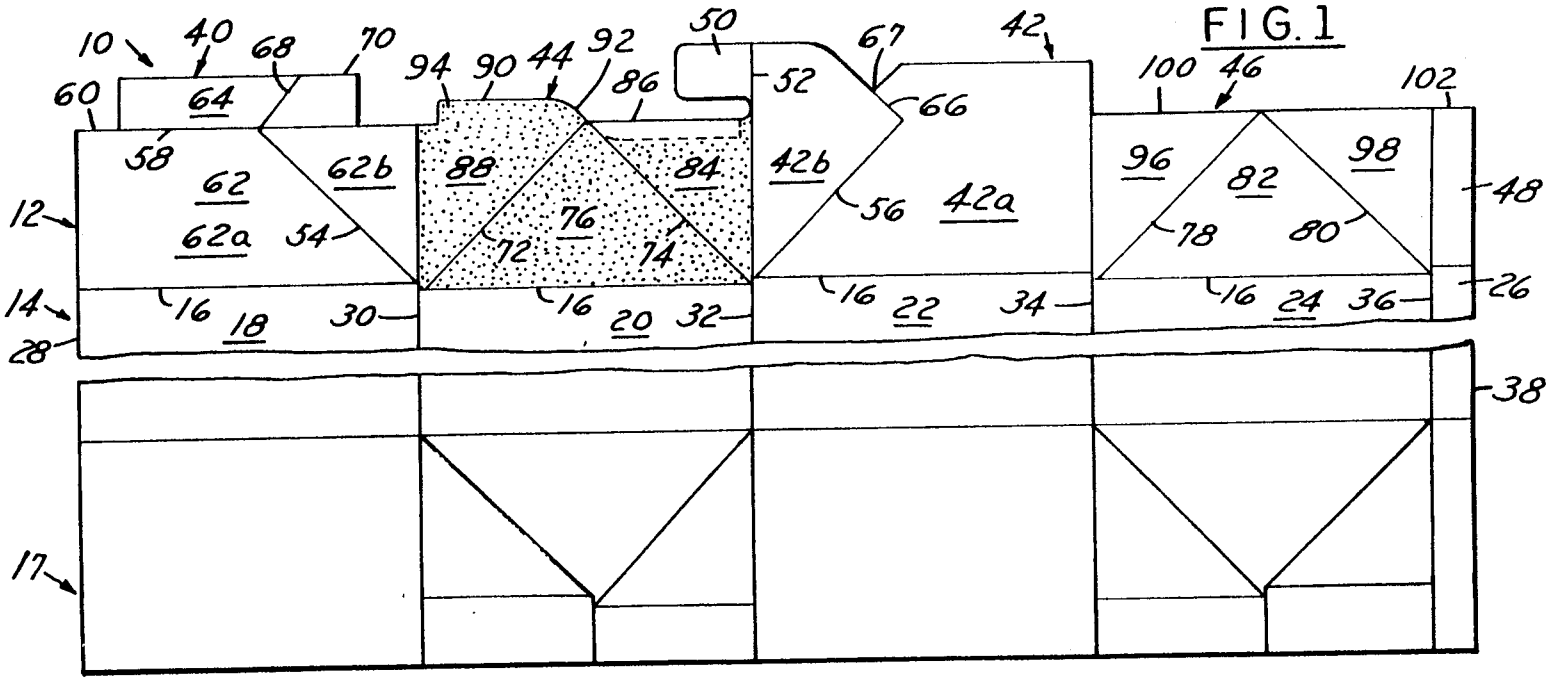
FIG. 1 is a layout view of the outside surface of a blank from which the top end closure of the invention is formed.
Figure 2:
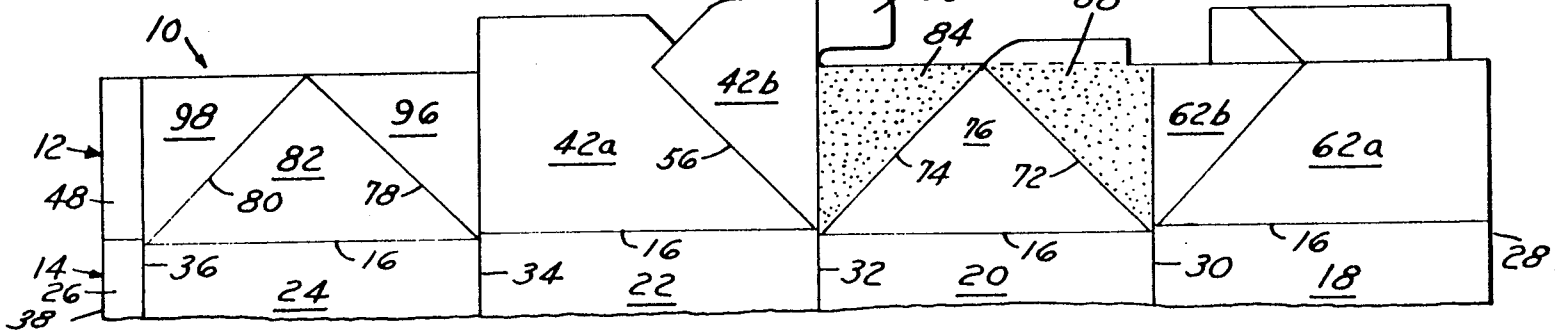
FIG. 2 is a layout view of the inside surface of the FIG. 1 blank.

Referring now to the drawings in greater detail, FIGS. 1 and 2 illustrate the respective outside and inside surfaces of a blank 10 including a top closure 12, a body portion 14, separated by a staggered horizontal score line 16, and a bottom closure portion 17 which forms no part of the invention. The body portion 14 includes a first side panel 18, a front panel 20, a second side panel 22, a back panel 24, and a narrow fifth panel or side seam 26. The panels 18, 20, 22, 24 and 26 are defined, respectively, by a first free cut edge 28, vertical score lines 30, 32, 34, and 36, and a second free cut edge 38. It should be noted that, while the four side panels are shown as having the same width, resulting in a square cross-section container, it is possible to have two wide and two narrow panels, e.g., panels 18 and 22 could be wider than panels 20 and 24, to produce a rectangular cross-section container.

A pair of outer top closure panels 40 and 42 are integrally connected to the first and second side panels 18 and 22, respectively, at the score line 16. A pair of fold-in top panels 44 and 46 are integrally connected to the front and back panels 20 and 24, respectively, at the score line 16. An end closure extension 48 of the side seam 26 is integrally connected to the latter at the score line 16 and to the fold-in panel 46 at the extension of the score line 36. The panel 44 will serve as a pour spout, as will be explained.

A lift tab 50 is formed on the upper edge portion of the top panel 42 so as to be integrally connected thereto by a score line 52, which is substantially an extension of the vertical score line 32. The lift tab 50 is separated from the adjacent panel 44 in a manner to be described.

Opening-assist diagonal score lines 54 and 56 are formed on the outer top panels 40 and 42, respectively. The score line 54 may extend from the intersection of the vertical score line 30 and the horizontal score line 16, or adjacent thereto, to a horizontal score line 58 formed across the panel 40. The score line 58 terminates in a free cut edge 60, and divides the panel 40 into panels 62 and 64, while the diagonal score line 54 divides the panel 62 into segments **62*a* and 62*b*, the latter serving as fold-back panel. The score line 56 may extend from the intersection of the score lines 32 and 16, or adjacent thereto, to a point on the panel 42 approximately on line with the score line 58. A short weakened line 66 extends form the end of the diagonal score line 56 to a notch 67 formed in the edge of the panel 42, completing the division of the panel 42 into segments 42*a* and 42*b*, the lift tab 50 extending form the segment 42*b* and the latter serving as a fold-back panel. A diagonal score line 68 is formed across the panel 64 from the end of the diagonal score line 54 at the score line 58, to the free cut edge 70 of the panel 64**.

A pair of converging diagonal score lines 72 and 74 are formed on the fold-in top panel 44, forming a triangular pouring panel 76 with the horizontal score line 16. Likewise, a pair of converging diagonal score lines 78 and 80 are formed on the fold-in top panel 46, forming a triangular panel 82 with the horizontal score line 16. The diagonal score lines 72, 74, 78 and 80 are preferably formed such that they substantially intersect the junctures of the score lines 30 and 16, 32 and 16, 34 and 16, and 36 and 16, respectively, but may be spaced therefrom, along the score line 16, a distance which substantially accommodates the thickness of the paperboard when folded into a container.

The panel 44 further includes a pair of fold-back panel segments, one of which is a segment 84 formed between the score lines 74 and 32 and a free cut edge 86. The other fold-back panel segment is a longer segment 88 formed between the score lines 72 and 30 and an edge consisting of a straight portion 90 and a portion 92 which extends at an angle between the adjacent ends of the edges 86 and 90, with one end substantially aligned with the diagonal score line 74 and the other end arcuately connected to the free cut edge 90.

It is the area of the longer panel portion 88 which extends beyond a continuation of the line formed by the straight edge portion 86 which is adapted to serve as a lift tab 94, as will be explained.

The fold-in panel 46 includes fold-back panel segments 96 and 98. The panel segment 96 is defined by the score lines 78 and 34 and a straight free cut edge 100 of the panel 46. The panel segment 98 is defined by the score lines 80 and 36 and a straight free cut edge 100. A free cut edge 102 at the end of the side seam extension 48 aligns with the straight edge 100.

Referring once again to FIGS. 1 and 2, the outside surfaces of the fold-in pour spout panels 76, 84 and 88 are substantially covered by a suitable anti-adhesive or "abhesive", such as an organo-siloxane gum composition. The same abhesive is applied to the inside surfaces of either the fold-back panel segments 84 and 88, or the adjacent panel segments **42*b* and 62*b***.

Inasmuch as, in some applications, the typical chemicals used to sterilize the containers, such as a hydrogen peroxide fog or mist, may not thoroughly penetrate the inside mating surfaces which have been coated with an abhesive and, hence, do not seal as completely as other surfaces, it is possible for the product to contact those surfaces and penetrate the interstices thereof. It is desirable to seal off such surfaces and their interstices to prevent product penetration when aseptic filling is involved. Accordingly, a molten sealant or caulking material, for example, a hot melt solution or a wax, is applied over the inside abhesive coated panel segments, i.e., either the panel segments 84 and 88, or the segments **42*b* and 62*b*, with the application to the segments 42*b* and 88 terminating at a line which is aligned with the free cut edges of the segments 62*b* and 84, as indicated on FIG. 2**.

Thus, when the container is formed, the surfaces of all of the segments 84, 88, **42*b* and 62*b*** are heated in the usual manner, now including the additional sealant cover. When folded and sealed thereafter, any possible contaminants are isolated by the sealant material. When the container is opened and the pour spout unfolded, separation readily occurs by virtue of the underlying abhesive.

The forming, sealing and opening processes will now be explained.

Figure 3:
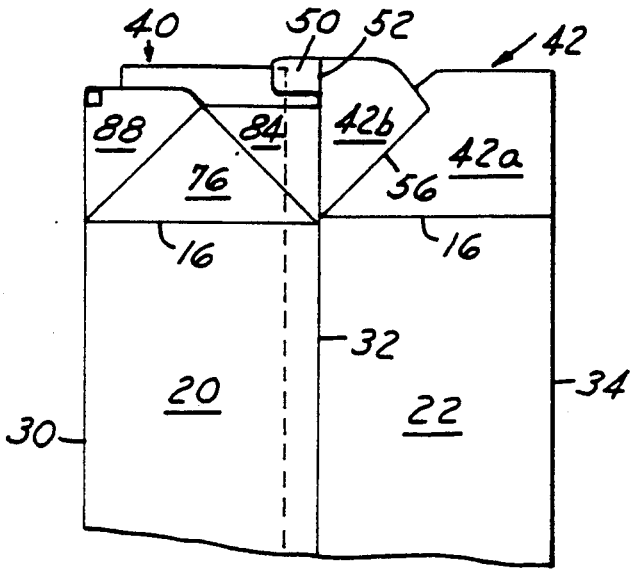
FIG. 3 is a fragmentary layout view of the outside surface of a blank after it is side seamed from the blank illustrated in FIGS. 1 and 2.

The container blank 10 illustrated in FIGS. 1 and 2 is first formed into a side seamed blank, as illustrated in FIG. 3, by rotating the body panel 24 and the side seam flap 26 as a unit about the vertical score line 34, and having the inside surfaces of the body panel 24 come into contact with the inside surface of the body panel 22, with the vertical score line 36 positioned next to the vertical score line 32, and with the inside surface of the side seam flap 26 in contact with the inside surface of the body panel 20 adjacent the vertical score line 32. The body panel 18 is then rotated about the vertical score line 30 to bring its inside surface into contact with the outside surface of the side seam flap 26, and the edge 28 is positioned parallel and substantially aligned with the vertical score line 36. The various members of the end closure 12 will make similar movements, and the container will appear as illustrated in FIG. 2. The container blank 10 is then sealed where the inside areas of the body panel 18 and the closure panel 40 come into contact with the outside surface of the side seam flap 26 and its extension 48.

Figure 4:
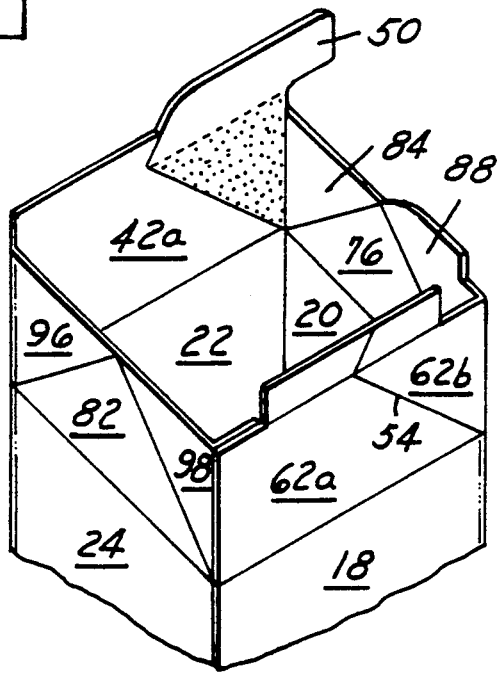
FIGS. 4 and 5 are fragmentary perspective views illustrating sequentially various steps in forming the flat top end closure.

The next step in forming the side seam blank into a container is illustrated in FIG. 4. The side seam blank is opened up into one of a predetermined squared or rectangular configuration, after which the various parts of the end closure 12 are folded about the various score lines in the following manner. The triangular closure panels 76 and 82 are moved around the horizontal score line 16 over the end of the container toward each other. At the same time, the outer panels 40 and 42 are also moved toward each other about the horizontal score line 16. This causes the fold-back panel segment 88 to bend around the vertical score line 30 such that the inside surfaces of the panel segment 88 and the outer panel 40 are approaching each other. Concurrently, the fold-back panel segment 84 is moved around the diagonal score line 74 such that the inside surfaces of the panel segment 84 and the panel 42 are approaching each other. The outside surfaces of the two fold-back panel segments 88 and 84 approach the outside of the triangular panel 76. The fold-back panel segments 96 and 98 make the same movements as described for the panel segments 84 and 88, with respect to their adjacent panels 42 and 82, and 40 and 82, respectively.

Figure 5:
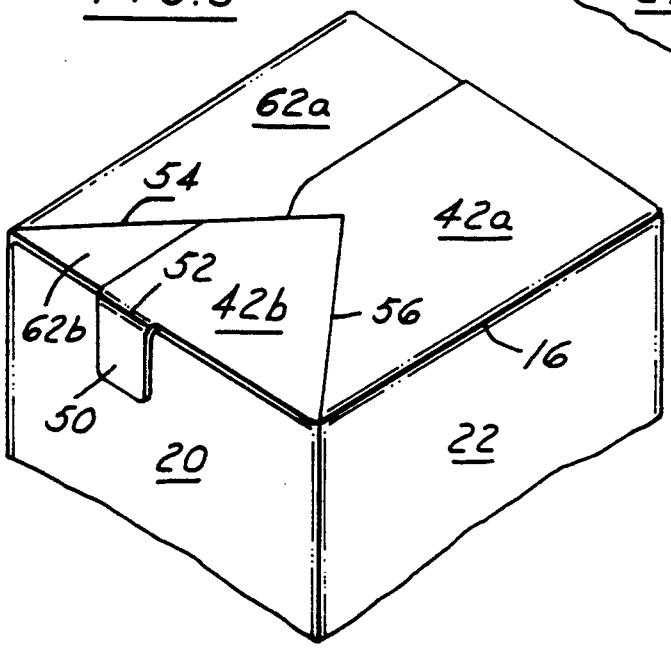

During the folding operation, the outer panel 42 contacts the panel portion 64 of the outer panel 40. The panel portion 64 is moved around the score line 58, approaching the panel portion 62. The result, as may be noted in FIG. 5, is that an edge portion of the outer panel 42 overlaps and is sealed to the panel portion 64 of the outer panel 40, and the edge portion 94 of the panel 88 underlies the edge portion of the panel segment 84.

The lift tap 50 (FIG. 5) may be bent downwardly about the score line 52 and sealed against the front panel 20 to accommodate shipping and stacking.

Figure 6:
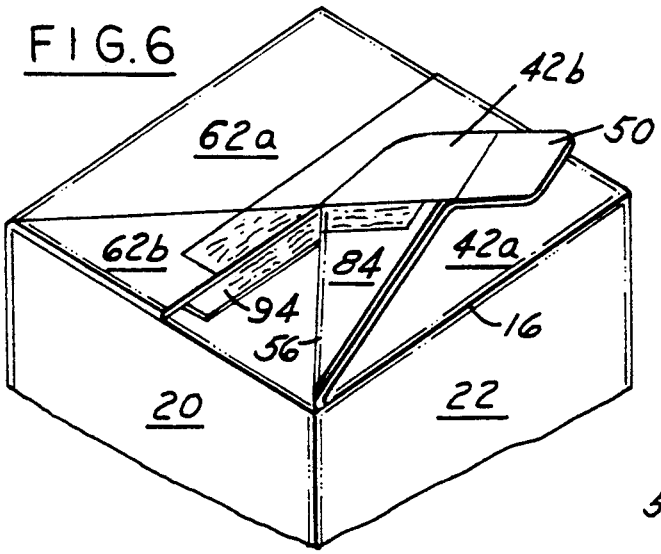
FIGS. 6 and 7 are fragmentary perspective views illustrating sequentially various steps in opening the flat top end closure.
Figure 7:
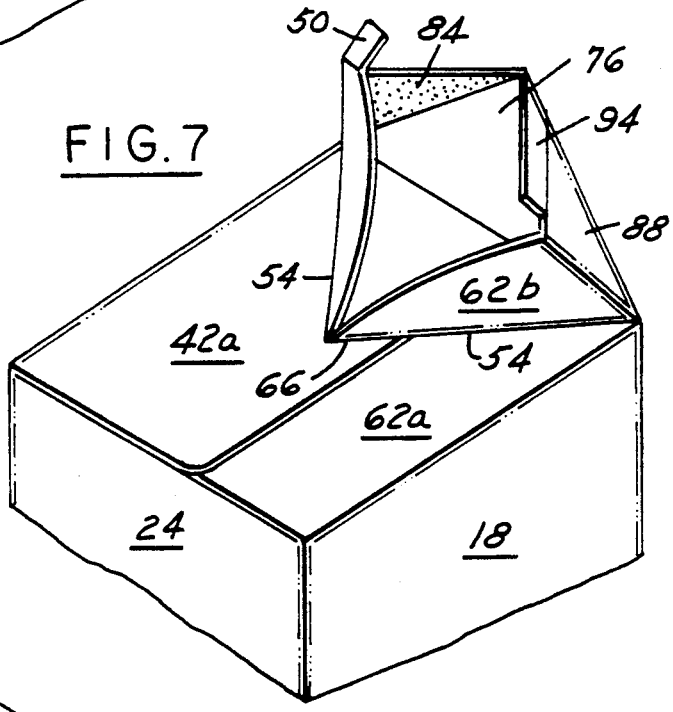
Figure 8:
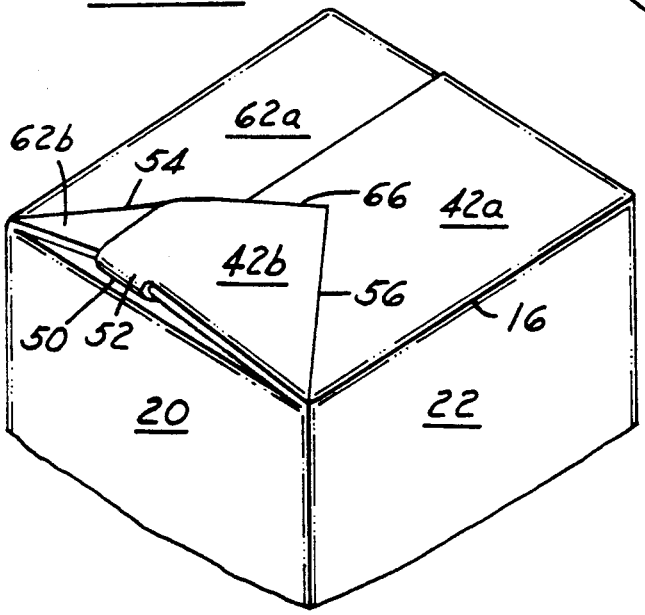
FIG. 8 is a fragmentary perspective view similar to FIG. 5, showing the top closure in a reclosed condition after having been opened.

Referring now to FIG. 6, it may be noted that opening of the flat top closure is effectuated by releasing the lift tap 50 from the front body panel 20 and then using the released tap to lift the outer roof panel segment **42*b*, tearing the score line 66 and lifting the underlying panel segment 84. The panel segments 42*b* and 84 are moved about the respective diagonal score lines 56 and 74. This exposes the underlying portions of the panels 84, such that one may grasp the now exposed lift tab 94 portion of the panel 88, as defined by the free cut edges 90 and 92. Thus, by grasping and lifting the lift tab 94, the panel segments 88 and 62*b* are moved about the diagonal score lines 72 and 54, respectively. The pour spout shown in FIG. 7 is then opened as follows: the panel segments 76, 84 and 88 of the panel 44 are caused to assume a substantially planar attitude, with the score lines 54, 72 and 56, 74 serving to cause the front spout panels 84 and 88 to separate from the rear spout panels 42*b* and 62*b*, whereupon pressure against the vertical edge score line 30 and 32 tends to cause the triangular panel portion 76 to extend outwardly (FIG. 7). The lift tab 94 is then used to lift up the panel segment 88 and, hence, the triangular panel portion 76 and the panel segment 84 from their planar attitude and beyond, into the usual pitcher pour spout for dispensing the contents of the container. The pour spout may, of course, be generally reclosed after use. As shown in FIG. 9, the lift tab 50 may be tucked inwardly, between the fold-back panel 84 and the triangular pouring panel 76** to effectuate a "locking" condition for the reclosed flat top structure.

INDUSTRIAL APPLICABILITY

It should be apparent that the flat top closure of the invention may be aseptically sealed and yet easily opened by virtue of the combination of anti-adhesive or abhesive and suitable overlying sealant.

It should also be apparent that the flat top container involved may be either square or rectangular in cross-section.

While but two embodiments of the invention have been shown and described, other modifications thereof are possible within the scope of the following claims.

The embodiments of the invention in which an exclusive property or privilege is claimed are defined as follows:

1. In a flat top end closure for a liquid carrying, thermoplastic-coated paperboard container having a tubular body and including two oppositely disposed infolded panels and two oppositely disposed outer closure panels, one of said infolded panels adapted to serve as a pour spout, said infolded panels each including a substantially triangular panel portion defined by converging diagonal score lines and being integrally connected to said tubular body, and an inner pair of fold-back panels integrally connected to and folded between each of said substantially triangular panel portions and the respective adjacent outer closure panels, said two oppositely disposed outer closure panels including one shorter and one longer panel, with the edge portion of said longer panel overlapping the edge portion of said shorter panel and each having a diagonal opening-assist score line formed thereon to define an outer pair of fold-back panels adjacent said inner pair of fold-back panels, a first lift tab formed on a side edge of said longer panel for lifting the portion of said overlying longer panel adjacent its diagonal opening-assist score line and the integrally connected underlying inner fold-back panel of said pouring spout, and a second lift tab formed on the other of said fold-back panels of said pouring spout for lifting said other inner fold-back panel and the portion of said overlying shorter closure panel adjacent its diagonal opening assist score line to enhance the opening of the infolded panel bearing said second lift tab into said pour spout, characterized by an abhesive applied to the outside surfaces of the triangular panel portion and inner pair of fold-back panels of said pour spout, and to the inside surfaces of one of the pair of pour spout inner fold-back panels and the adjacent pair of outer fold-back panels formed by said opening-assist score lines, and a caulking material applied to overcoat the inside abhesive surfaces, to prevent product penetration when aseptic filling is involved.

2. In the flat top end closure described in claim 1, wherein said abhesive and caulking material are applied to each of said pair of inner fold-back panels of said pour spout.

3. In the flat top end closure described in claim 1, wherein said abhesive and caulking material are applied to each of said adjacent pair of outer fold-back panels formed by said opening-assist score lines.

4. In the flat top end closure described in claim 1, wherein said caulking material is a hot melt solution.

5. In the flat top end closure described in claim 1, wherein said caulking material is a wax.

6. In the flat top end closure described in claim 5, wherein said abhesive is an organo-siloxane gum composition.

* * * * *